United States Patent [19]

Malsot

[11] 4,162,816

[45] Jul. 31, 1979

[54] MULTI-CHANNEL SELF-CORRECTING CONNECTOR

[75] Inventor: Christian Malsot, Suresnes, France

[73] Assignee: Socapex, Suresnes, France

[21] Appl. No.: 864,704

[22] Filed: Dec. 27, 1977

[30] Foreign Application Priority Data

Dec. 31, 1976 [FR] France ..... 76 39719

[51] Int. Cl.[2] ..... H01R 9/04

[52] U.S. Cl. ..... 339/64 M; 339/66 M

[58] Field of Search ..... 339/47, 48, 49, 64, 339/65, 66

[56] References Cited

U.S. PATENT DOCUMENTS

| | | | |
|---|---|---|---|
| 436,857 | 9/1890 | Jones | 339/47 R |
| 462,793 | 11/1891 | Collier et al. | 339/192 R |
| 2,606,224 | 8/1952 | Modrey | 339/49 R |
| 3,252,124 | 5/1966 | Hansen | 339/47 R |
| 3,573,710 | 4/1971 | Wofford | 339/49 B |
| 3,930,705 | 1/1976 | Gallagher | 339/66 M |

FOREIGN PATENT DOCUMENTS

| | | | |
|---|---|---|---|
| 18630 | of 1898 | United Kingdom | 339/47 R |

*Primary Examiner*—Gerald A. Dost

*Attorney, Agent, or Firm*—Cushman, Darby & Cushman

[57] ABSTRACT

Connector of the multi-channel type, comprising two ferrules, the angular orientation by which the conductive contacts are positioned opposite one another, provided by end surfaces, at which said contacts open, shaped in the form of a plane inclined at the same angle relative to a plane perpendicular to the longitudinal axis, by which the two ferrules are automatically oriented angularly into a single matching position, when said end surfaces are in contact.

26 Claims, 12 Drawing Figures

FIG. 1
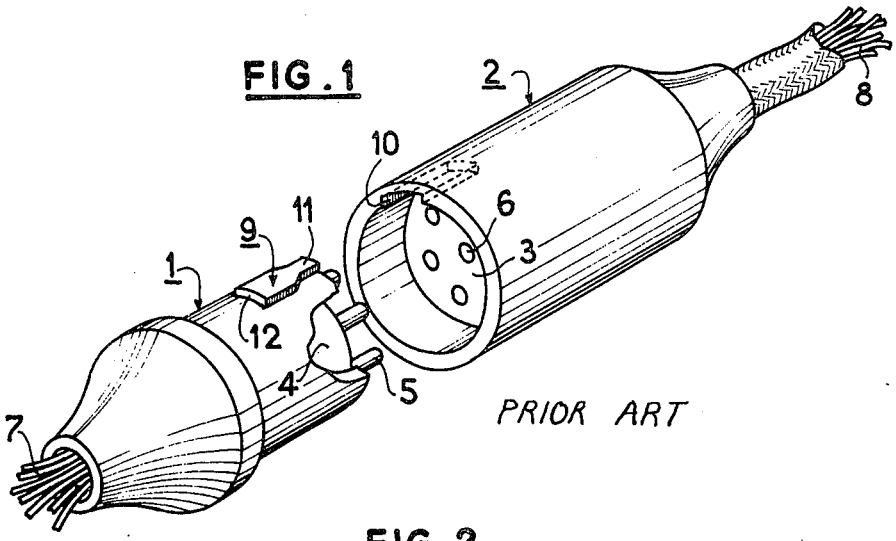
FIG. 2
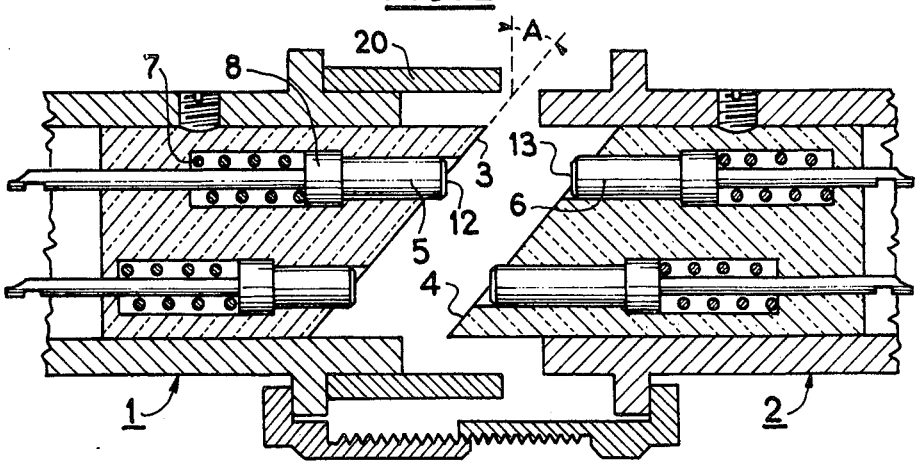
FIG. 3
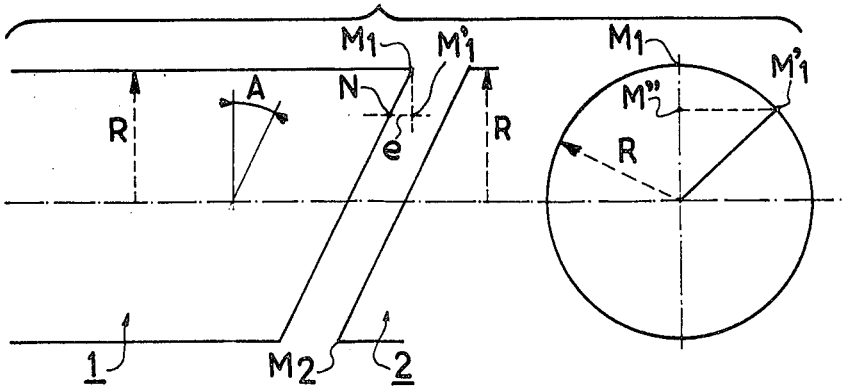
FIG. 3a FIG. 3b

MULTI-CHANNEL SELF-CORRECTING CONNECTOR

This invention relates to the field of connectors, i.e. devices intended for establishing a connection between two lines carrying a physical quantity, such as for example an electromagnetic field, an electrical current or a liquid or gaseous fluid.

When each line comprises only one conduit or "channel", the design, construction and application of a connector involves few difficulties and is based on the use of two ferrules respectively fixed to the ends of the two lines to be connected, each ferrule having a contact surface where the conduit of the line opens. The connection is established simply by placing the surfaces of the ferrules opposite one another so that the ends of two conduit sections to be connected are positioned opposite one another. In certain applications, the co-operating parts either of the ferrules or of the conduits have a geometrically complementary form, allowing partial penetration of the one into the other by longitudinal displacement, improving the characteristics of the connection thus established.

However, devices such as these, although simple in cases where it is only a question of connecting two lines to a single conduit, become considerably more complicated when the line comprises a plurality of conduits. In this case, several conduits or "channels" open at the contact surface of a ferrule, those parts of these conduits or "channels" which emerge from said surface being distributed over it, as seen in cross-section, in a given geometric pattern which has to be symmetrically reconstituted on the contact surface of the complementary ferrule so as to ensure the continuity of each homologous channel after connection.

So far as the rational connecting operation itself is concerned, the connector has to satisfy several requirements. On the one hand, it must only allow the contact surfaces to be placed opposite one another if the respective complementary emerging parts of each homologous channel are themselves opposite, thus establishing without error or ambiguity the superposition of the two symmetrical geometric patterns in which they are distributed. On the other hand, once this result has been obtained, they must ensure effective guiding of the displacement of one ferrule relative to the other in order to obtain precise opposite positioning in the final stage of the connection, thereby ensuring a connection with low-loss transmission characteristics and, hence, of high technical quality. This double requirement has lead to the use of geometric control elements of known type, such as projecting or recessed parts, respectively carried by the two ferrules and normally referred to as correcting elements. In practice, however, the presence of known elements of this type involves serious disadvantages.

First of all, the correcting elements generally require visual inspection during the connecting operation which can prove difficult in certain practical applications. In particular, when the ferrules are generally in the form of cylinders of revolution, which is most frequently the case in practice, the connection requires a series of systematic tests by rotating one of the ferrules relative to the other about its axis of symmetry so as to arrive at the correct angular orientation required by the use, with mutual co-operation of correcting elements with which the ferrules are provided. More generally, high friction forces are often encountered where a considerable number of conduits is to be connected, associated with the fact that, in this case, high geometric precision has to be obtained during production.

Accordingly, where results of high technical quality are required, the precision in the design and construction of the correcting and guide elements which results from conventional solutions leads to high manufacturing costs and to considerable difficulties in the practical application of the connectors.

These disadvantages are particularly marked when the dimensions of the conduits to be connected decrease and assume a fundamental character in cases where, as is being more frequently encountered in practice, the lines to be connected are intended for the transmission of electromagnetic energy in the range of frequencies close to the visible range.

As a result of the wavelengths used, these conduits or optical conductors, which are made of transparent materials, have diameters typically of the order of 100 microns and, to guarantee as low an energy loss as possible during connection, a geometric precision in the opposite positioning typically of the order of more or less 5 microns is necessary for the position of the homologous cross-sections of the parts respectively emerging from the two opposite contact surfaces. Conventional connectors for multi-channel optical lines which might satisfy requirements such as these for a standard practical industrial application would lead to serious financial and practical disadvantages.

The self-correcting multi-channel corrector according to the present invention does not have any of these disadvantages. It is simple in structure and does not require the presence of high-precision elements which leads to reduced manufacturing costs. The precision obtained in the coincidence of the homologous conduits opening opposite one another at the contact surfaces of the respective ferrules is at least equal to that mentioned above in the case of optical lines. Finally, its application does not require visual inspection or considerable mechanical efforts during the connecting operation.

In principle, after the geometric coincidence of the longitudinal axes of the opposite ferrules has been established by known means, the invention uses new means, namely a shape in the form of a plane inclined at the same angle relative to the axes of the ferrules imparted to the integral surfaces of the two ferrules which, when brought into contact with one another, ensure the precise, instantaneous angular orientation required. This is because the two portions of the inclined planes can only be brought into complete contact with one another during connection for a single mutual orientation of the two ferrules. In some applications of the invention, these surfaces may be formed by those of the contact surfaces of the ferrules themselves and will be referred to hereinafter as "supporting surfaces".

By bringing the two inclined planes into contact with one another by the application of a force directed parallel to the longitudinal axes of the ferrules, the coincidence of all the homologous points of the respective supporting surfaces of the ferrules is ensured in consequence as, hence, is the creation of a single angular orientation.

As will be explained in detail hereinafter, the particular angular orientation required is obtained with high precision, so that there is no need to use precise correcting elements, such as, for example, tenons and grooves substantially free from play.

In addition, it is the longitudinal force applied to carry out the connecting operation which simultaneously provides the moment of rotation required for obtaining the desired angular orientation.

Finally, after the end of the connecting stage, the permanent application of a longitudinal force of sufficient values to overcome the influence of friction between the inclined planes maintains if necessary the orientation obtained and retains its angular precision.

Accordingly, the present invention relates more precisely to a connector of the multichannel self-correcting type formed by a pair of ferrules having a longitudinal axis of symmetry and provided with means for centering these ferrules of which each comprises, on the front part, a contact surface and a plurality of contact elements opening onto said surfaces, characterised in that the ferrules of one pair are provided with supporting surfaces forming portions of planes inclined at the same angle relative to the plane perpendicular to said longitudinal axis of symmetry which, when brought into contact with one another, effect said correction.

The invention will be better understood from the following description in conjunction with the accompanying drawings, wherein:

FIG. 1 shows a multi-channel line connector according to the prior art.

FIG. 2 shows an electrical self-correcting connector for end contacts according to the invention.

FIG. 3(a) (b) is a diagram explaining the operation of the connector according to the invention.

Figure 4:
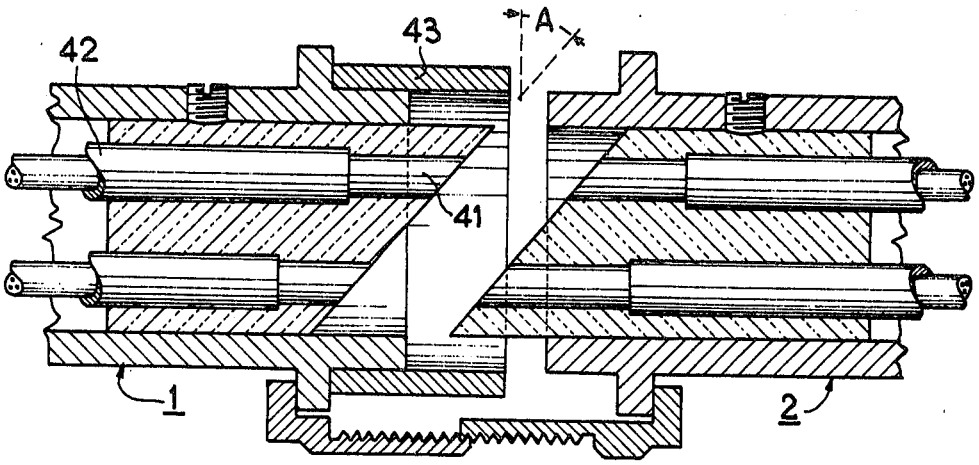
Figure 5:
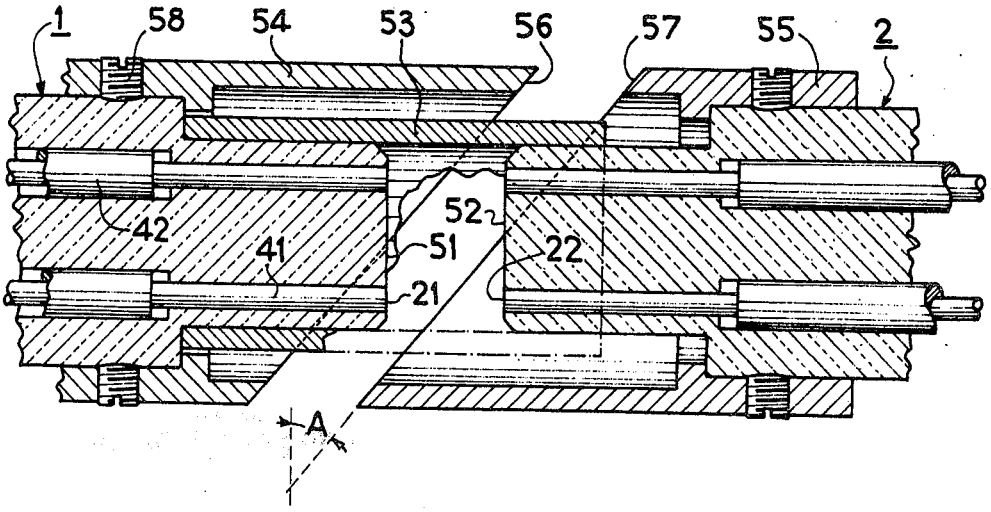

FIGS. 4 and 5 show two embodiments of the connector according to the invention for an optical line.

Figure 6:
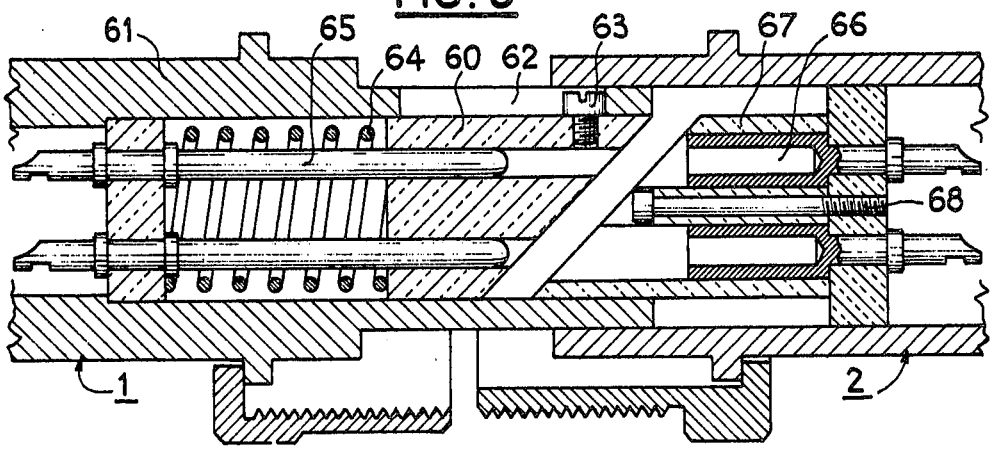
Figure 7:
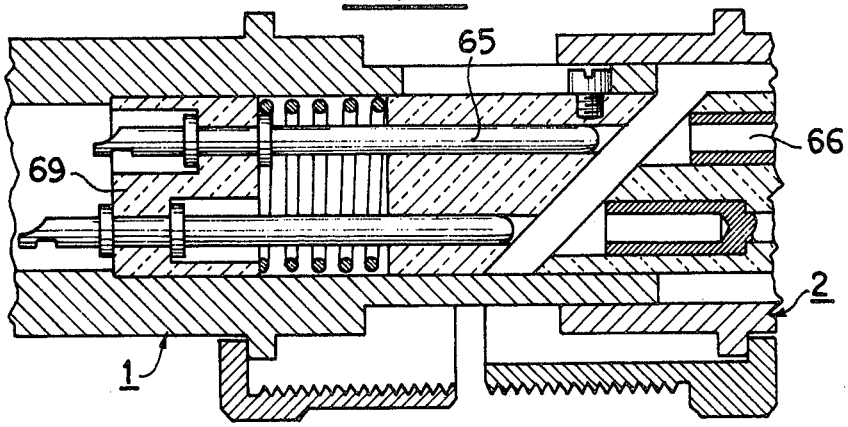

FIGS. 6 and 7 show two embodiments for an electrical line.

Figure 8:
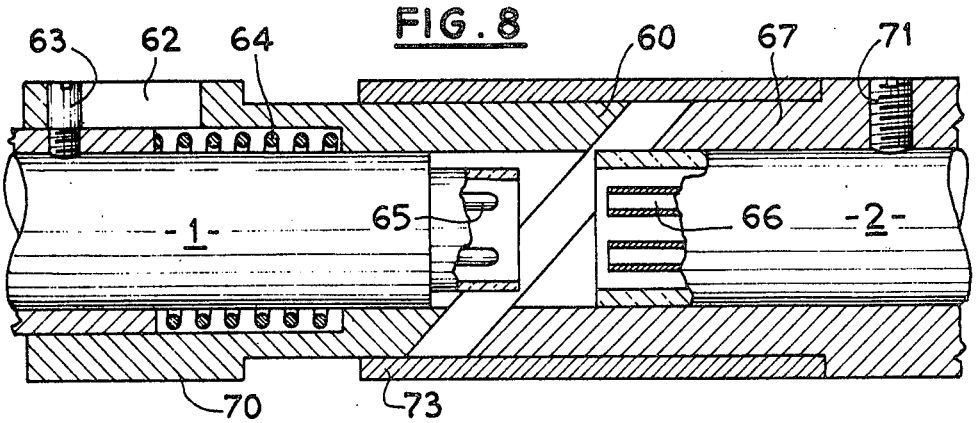
Figure 9:
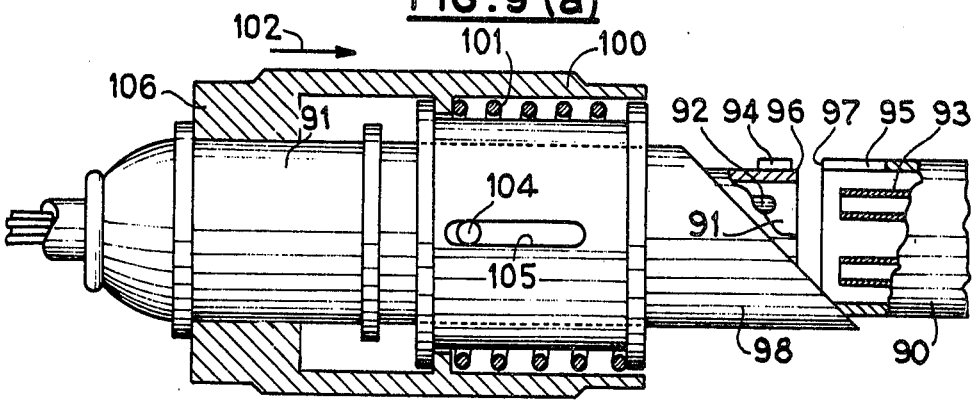
Figure 9:
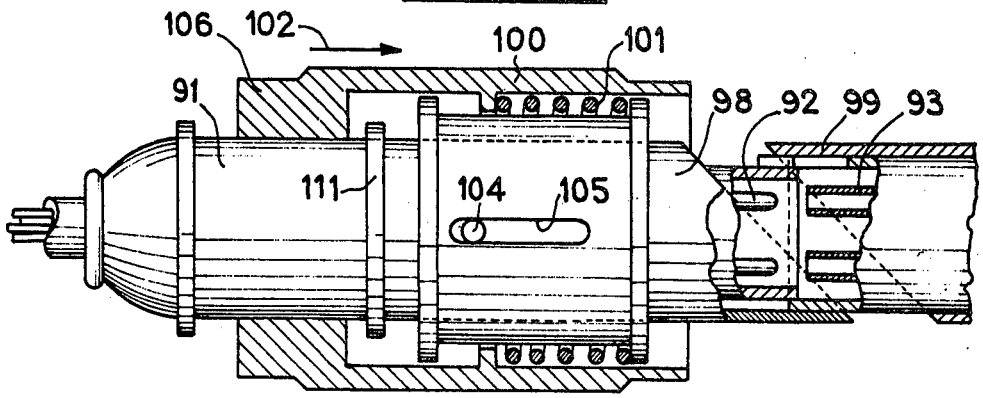
Figure 9:
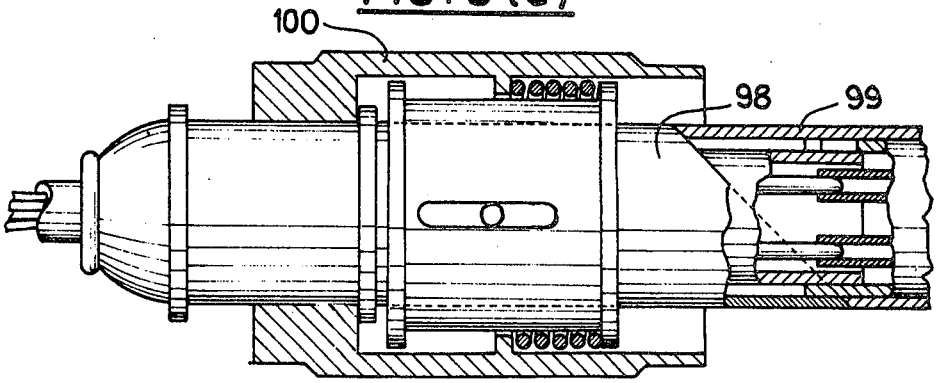

FIGS. 8 and 9 (a), (b), (c) show another two embodiments adapted to electrical connectors of known type.

FIG. 1 shows a multi-channel connector according to the prior art. This connector consists of two ferrules 1 and 2 of which the contact surfaces 3 and 4, perpendicular to the longitudinal axes of the ferrules, carry a plurality of connecting elements, such as 5 and 6, to which lead the channels, such as 7 and 8, to be connected. The term "ferrule" is here intended to identify the entire structure of half of a connector, constituted by a sum of elements. The connection is made by bringing the homologous connecting elements carried by the surfaces 3 and 4 into contact with one another, which results in the need for a precision relative angular orientation of the two ferrules. To obtain this result, use is normally made of pairs of elements respectively carried by the two ferrules which are known as correcting elements. The ferrule 1 comprises a tenon 9 and the ferrule 2 a groove 10 of complementary shape. During the connecting operation, the penetration of the ferrule 1 into the ferrule 2, before the channels themselves are placed in communication with one another, is only possible if the elements 9 and 10 are substantially opposite one another, which requires a given angular orientation.

As mentioned above, this gives rise to troublesome consequences in the manufacture and use of the connectors. The correcting tenon 9 of the connector shown in FIG. 1 is provided with two parts, a narrow front part 11 which, in a first step, allows penetration with considerable "play", thereby facilitating the task of the user in his search for the correct angle and reducing friction, and a rear part 12 comparable in width to the groove 10 which, in a second step, effects the precise opposite positioning of the channels to be placed in communication with one another.

The practical construction of the correcting elements designed in accordance with these principles requires a precision adapted to the type of lines to be connected and is particularly difficult and expensive in the case of optical lines where the opposite positioning has to be effected with a precision of the order of a few micrometers. In addition, it should be noted that the variations, allowed by the "plays", in the angular position as a function of time under various influences, such as for example mechanical vibrations, are not eliminated by a structure of this type.

FIG. 2 shows a first embodiment of a self-correcting multi-channel connector according to the invention in cases where the channels to be connected are electrical lines. This FIG., where the same elements are denoted by the same reference numerals, shows the fundamental characteristic of the invention, namely the contact surfaces 3 and 4 which are no longer perpendicular to the longitudinal axis of the ferrules which carry them, but instead form with this axis the same angle A different from 90°, for example 45° in one typical case. During the connecting operation, the user applies a force along the longitudinal axis of the ferrules 1 and 2 positioned opposite one another. Accordingly, these ferrules move towards one another in a first step guided by the sleeve 20 which ensures the coincidence of their longitudinal axes. However, they generally show an arbitrary angular orientation relative to one another. It is then that a second step occurs in the connector according to the invention, representing an unexpected phenomenon, namely a rotation of one of the ferrules relative to the other due to the presence of the inclined surfaces under the action of the longitudinally applied force. This rotation continues until the ferrules are in the position in which the two surfaces 3 and 4 are in complete contact with one another. The two ferrules 1 and 2 are then in complete contact with one another, occupying a minimum length along their axis, and the homologous electrical elements, such as 5 and 6, are in communication with one another.

During the final phase of the rotation of one of the ferrules to the other, the electrical contacts 5 and 6 respectively carried by the ferrules should only project slightly to avoid the danger of premature contact. Accordingly, they terminate in rounded or frustoconical contact facets 12 and 13 and can retract longitudinally by virtue of elastic elements 7 on which they rest through small collars 8. In practical application, however, a mode of contact such as this should be reserved for limited electrical intensities, such as those used in electrical bulbs with sockets of the "bayonet" type for example.

FIG. 3 shows a diagram explaining the self-correcting mechanism belonging to the connector according to the invention. The two ferrules 1 and 2 are shown in longitudinal section at (a) and in cross-section at (b). The operation of the assembly will be described hereinafter, showing the origin of the moment of rotation responsible for correcting. Starting from the state of the connector in which the two inclined supporting surfaces are parallel to one another and by turning one of the surfaces through an angle B, the two surfaces will move apart from one another, the two projecting points $M_1$ and $M_2$ alone remaining respectively in contact with the surfaces which are opposite them.

For an angle of rotation B, the point $M_1$ will assume the position $M'_1$ and the distance e by which the two ferrules will move apart from one another will be given by the relation $e=\overline{M'_1N}=\overline{M_1M''}$ tg $\hat{A}$, where $\overline{M_1M''}=R(1-\cos \hat{B})$. Accordingly, $e=R$ tg $\hat{A}(1-\cos B)$.

It follows from this relation that, when the angle B is different from a value of zero, the interval between the two ferrules increases with the result that, if the frictional forces between the two inclined surfaces are kept at minimal values, any force applied longitudinally to the ferrules to reproduce this interval will develop a moment of rotation tending to eliminate the angle B, and will ensure the required automatic correction.

The relation shows that the sign of the angle $\hat{B}$ about its zero position does not intervene because the trigonometric line relating to it is a cosine. Accordingly, a restoring moment is created around the correct orientation position. The relation also shows that the interval will be greater for a given angle $\hat{B}$, the greater the angle of inclination $\hat{A}$ of the surfaces and the greater the external radius R of the supporting surfaces.

The moment of rotation developed by a longitudinal force will have greater effectiveness and precision in correction, the lower the coefficient of friction of the contacting surfaces.

This is why it is one of the features of the invention to form or cover these surfaces with a material having a low coefficient of friction either by physical means, such as polishing or lubrication, or by its chemical composition, such as polytetrafluoroethylene, or by mechanical elements, such as balls, even limited to certain parts of the contact surfaces.

A reduced coefficient of friction thus makes it possible to reduce either the external radius of the supporting surfaces or the angle of inclination which they form in relation to the plane perpendicular to the longitudinal axis. In practice, Applicants have found that angles comprised between 20° and 70° for a material of the supporting surfaces, such as polished brass, provided a moment of rotation exceeding the requirements of the connectors described and illustrated in the following Figures. In the connection of optical lines, an angle of 45° was found to be satisfactory.

Finally, it is pointed out that, by simultaneously machining the two supporting surfaces of a connector according to the invention, automatic correction is obtained for any angle comprised within the two specified limits. However, in cases where interchangeability is required for the applications envisaged, a single angle is preferable.

FIG. 4 shows an embodiment of the connector according to the invention intended for connecting optical lines comprising a plurality of channels. Its overall construction is the same as that of the electrical connector described and illustrated in FIG. 2. However, in view of the known processes for fixing optical lines in ferrules, generally be sealing or bonding the fibres 41 after removal of their protective cladding 42, said processes comprising polishing the contact surfaces of the fibres and ferrules, it is of particular advantage to subject the inclined surfaces to a final machining operation after the optical lines have been fixed in the ferrules.

FIG. 5 shows another preferred embodiment of the connector according to the invention in the case of lines for optical fibres. It is desirable that, in service, ferrules of known type should be able to benefit from the characteristic of automatic correction according to the invention.

These ferrules comprise sleeves, such as 51, having contact surfaces, such as 52, perpendicular to their longitudinal axis and a lateral surface in the form of a cylinder of revolution to ensure the coincidence of the longitudinal axes by a common centring sleeve, such as 53.

In addition, it was explained in detail earlier on that the precision of the correction obtained by using the inclined surfaces according to the invention is greater, the larger their external diameter.

The embodiment shown in FIG. 5 satisfies these two requirements. It uses separate jackets 54 and 55 with inclined supporting surfaces 56 and 57 attached to ferrules for optical lines of known type where they are fixed by screws, such as 58, allowing precise angular adjustment.

FIGS. 6 and 7 show two variants of another embodiment of the invention for connecting multi-channel electrical lines.

As already mentioned, the embodiment shown in FIG. 2 with "end" contacts has limitations in the electrical intensity to be transmitted. In addition, in cases where a connection under electrical voltage is required, certain troublesome contacts can occur momentarily during the final phase of rotation.

The embodiments shown in FIGS. 6 and 7 do not have these limitations.

They use known contact elements of complementary shape respectively called "male" and "female" and a displaceable protection block 60 accommodated in one of the ferrules 61. This protection block can slide in the ferrule where the amplitude of its displacement is defined by the elongate opening 62, into which a tenon 63 projects, and is normally in the protection position, in which the male pins are covered, under the action of a spring 64. It is the protection block which carries the inclined front supporting surface characteristic of the invention.

During the connecting operation, the pins are covered and, as explained above, automatic orientation is carried out until the inclined surfaces carried respectively by the protection block and the ferrule opposite it are in complete contact. Since the force applied by the user is subsequently maintained, the spring 64 is compressed, the pins 65 project relative to the contact surface of the protection block and enter the female contacts or sockets of the opposite ferrule 66.

Since the force required to compress the spring only has to intervene after the correct angular orientation has been obtained, the stiffness of the spring should be selected to ensure that the value of this force is higher than that of the frictional forces developed between the inclined surfaces.

The embodiment illustrated in FIG. 6 relates to the equipping of existing connectors which it is possible to convert in accordance with the invention by the addition of blocks 60 and 67, the fixed block being fixed by the screw 68. However, this results in the need for pins 65 which are long enough to adapt themselves to the total amplitude of the necessary displacement, which is fairly considerable, as a result of the length associated with the inclined plane.

In FIG. 7, the connector has been designed for the use of the invention and the contacts 65 and 66 are supported by a stepped baseplate 69. The amplitude of displacement of the protection block is thus reduced and the pins 65 are of substantially normal length.

FIG. 8 shows yet another embodiment of the connector according to the invention which may be directly adapted to a conventional electrical connector. It is similar in construction to the connector described and illustrated in FIGS. 6 and 7. The inclined supporting surfaces are carried by separate jackets 60 and 67, of which at least one is displaceable, and is kept in the protection position by a spring 64. The operation is the same as in the case of the connectors shown in FIGS. 6 and 7.

FIG. 9 shows a third embodiment of the connector according to the invention. This embodiment, which also lends itself to the fitting of the automatic correction elements characteristic of the invention to ferrules of known type, has the advantage of only allowing the actual connection to be made when the correction is complete. The two ferrules 90 and 91 which are respectively provided with male and female contacts 92 and 93 are provided with a tenon 94 and a groove 95 which can only be centred in one another by the penetration of their front surfaces 96 and 97, as shown at (*b*) in the Fig.

The penetration of the contact elements 92 and 93 is not normally possible unless the tenon and the groove are approximately oriented opposite one another according to the arrangement shown in FIG. 9 (*c*). The precision of these two elements is rough.

It is the function of the displaceable sleeves 98 and 99 with inclined supporting surfaces to ensure a precise orientation by translation and rotation of one of the ferrules supporting them.

However, it is essential that the final stage of penetration of the male elements 92 into the female elements 93 only takes place on total completion of the initial orientation step.

It is for this reason that, according to the invention, the element for controlling the connection, namely an outer ring 100, only applies the force required for connecting the contact elements to the ferrule after having applied to the sleeve with the inclined supporting surface 98 the longitudinal force by which the sleeve is rotated, as already explained. The succession of the application of the two forces is advantageously ensured by the spring 101.

A connector of this type operates as follows: after the ferrule 91 has been presented before the ferrule 90, the front surfaces 96 and 97 enter into one another, as shown in FIG. 9 (*b*), which ensures the coincidence of the longitudinal axes thereof, but not the possibility of penetration of the contacts 92 and 93 themselves.

To this end, a force is applied in the direction of the arrow 102 to the outer control ring 100 which can slide freely on the ferrule 91, but transmits the force applied to the sleeve with the inclined supporting surface 98 by way of the spring 101.

The sleeve 98 is thus angularly oriented relative to the sleeve 99, entraining in its rotation the ferrule supporting it by the action of the tenon 104 and the groove 105 respectively carried by the two sleeves.

Once the ferrule has been oriented, the second step can take place, namely the penetration of the elements 92 into the elements 93.

It is carried out under the action of the force which continues to be applied longitudinally to the control ring 100 of which a portion 106 comes into contact with the ferrule 91 and ensures the required penetration positively and without play.

These various embodiments of self-correcting connectors according to the invention have only been described and illustrated by way of example. It is obvious that the scope of the present invention includes any connector of which the particular mutual angular orientation or correction, which is necessary for connection, is obtained by the use of complete or limited supporting surfaces inclined relative to the longitudinal axis of the ferrules.

What is claimed is:

1. A multichannel connector comprising (1) a pair of cylindrical ferrules, each having
  (a) a longitudinal axis,
  (b) a supporting end face shaped in the form of a single plane, and encircling said longitudinal axis,
  (c) a contact surface, and
  (d) a plurality of corresponding contact elements in homologous relation opening at said surface;

(2) means for centering each of said ferrules so that said longitudinal axis of each of said ferrules coincide, said end faces being in confronting relation;

(3) said single plane of each ferrule being inclined at a same angle with respect to a plane, perpendicular said longitudinal axis;

(4) said end faces being of such dimension that said end faces make mutual contact when said ferrules are moved longitudinally toward each other; and (5) said contact between end faces when said ferrules are axially urged together causing a rotational coupling of faces to mate said end faces and said corresponding contact elements.

2. A connector as claimed in claim 1, characterised in that said supporting surfaces are formed by said contact surfaces.

3. A connector as claimed in claim 1, wherein said ferrules further comprise outer annular surfaces and said supporting surfaces are mounted inside said outer annular surfaces.

4. A connector as claimed in claim 1, wherein said ferrules further comprise outer annular surfaces and said supporting surfaces are located on said outer annular surfaces.

5. A connector as claimed in claim 1, characterised in that at least one of said supporting surfaces is capable of a translation movement parallel to said longitudinal axis.

6. A connector as claimed in claim 1, characterised in that said mutual contact is produced by an elastic means of which one end is fixed to said connector.

7. A connector as claimed in claim 6, wherein said centering means comprises an outer sleeve supported at one of the ferrlue outer surfaces, capable of a translation movement parallel to said longitudinal axis and fixed to the other end of said elastic means.

8. A connector as claimed in claim 1, characterised in that said contact elements are electrically conductive.

9. A connector as claimed in claim 1, characterised in that said contact elements are the transmission faces of optical fibres.

10. A connector as claimed in claim 1, characterised in that said supporting surfaces are formed by a material having a low coefficient of friction.

11. A connector as claimed in claim 1, characterised in that at least one of said supporting surfaces comprises balls.

12. A connector as claimed in claim 1, characterised in that said angle is comprised between 20° and 70°.

13. A connector as claimed in claim 2, wherein said ferrules further comprise outer annular surfaces and said supporting surfaces are mounted inside said outer annular surfaces.

14. A connector as claimed in claim 2, wherein said ferrules further comprise outer annular surfaces and said supporting surfaces are located on said outer annular surfaces.

15. A connector as claimed in claim 2, characterised in that said mutual contact is produced by an elastic means of which one end is fixed to said connector.

16. A connector as claimed in claim 3, characterised in that said mutual contact is produced by an elastic means of which one end is fixed to said connector.

17. A connector as claimed in claim 4, characterised in that said mutual contact is produced by an elastic means of which one end is fixed to said connector.

18. A connector as claimed in claim 5, characterised in that said mutual contact is produced by an elastic means of which end end is fixed to said connector.

19. A connector as claimed in claim 13, characterised in that said mutual contact is produced by an elastic means of which one end is fixed to said connector.

20. A connector as claimed in claim 14, characterised in that said mutual contact is produced by an elastic means of which one end is fixed to said connector.

21. A connector as claimed in claim 15, wherein said centering means comprises an outer sleeve support at one of the ferrule outer surfaces and capable of a translation movement parallel to said longitudinal axis is fixed to the other end of said elastic means.

22. A connector as claimed in claim 16, wherein said centering means comprises an outer sleeve support at one of the ferrule outer surfaces and capable of a translation movement parallel to said longitudinal axis is fixed to the other end of said elastic means.

23. A connector as claimed in claim 17, wherein said centering means comprises an outer sleeve support at one of the ferrule outer surfaces and capable of a translation movement parallel to said longitudinal axis is fixed to the other end of said elastic means.

24. A connector as claimed in claim 18, wherein said centering means comprises an outer sleeve support at one of the ferrule outer surfaces and capable of a translation movement parallel to said longitudinal axis is fixed to the other end of said elastic means.

25. A connector as claimed in claim 19, wherein said centering means comprises an outer sleeve support at one of the ferrule outer surfaces and capable of a translation movement parallel to said longitudinal axis is fixed to the other end of said elastic means.

26. A connector as claimed in claim 20, wherein said centering means comprises an outer sleeve support at one of the ferrule outer surfaces and capable of a translation movement parallel to said longitudinal axis is fixed to the other end of said elastic means.

* * * * *